United States Patent [19]

Elliott et al.

[11] Patent Number: 4,472,859

[45] Date of Patent: Sep. 25, 1984

[54] CARD SCREEN ASSEMBLY

[76] Inventors: Olin S. Elliott, 2011 Cleveland St.; Leonard J. Furlough, Rte. 14, 32 Brook Dr., both of Greenville, S.C. 29607

[21] Appl. No.: 181,772

[22] Filed: Aug. 27, 1980

[51] Int. Cl.[3] ..... D01G 15/42

[52] U.S. Cl. ..... 19/105; 19/107

[58] Field of Search ..... 19/95, 105, 107

[56] References Cited

U.S. PATENT DOCUMENTS

| | | | |
|---|---|---|---|
| 244,393 | 7/1881 | Keene | 19/95 |
| 620,089 | 2/1899 | Threlfall | 19/105 |
| 2,188,458 | 1/1940 | Jenkins et al. | 19/107 |
| 2,289,017 | 7/1942 | Jenkins et al. | 19/107 |
| 2,681,478 | 6/1954 | Shaw et al. | 19/95 |
| 3,537,144 | 11/1970 | King | 19/107 |
| 3,955,244 | 5/1976 | Jenkins | 19/107 |
| 4,008,511 | 2/1977 | Oda | 19/105 |
| 4,135,275 | 1/1979 | Gunter et al. | 19/107 |

*Primary Examiner*—Louis Rimrodt

[57] ABSTRACT

The drawing illustrates a card screen comprising a fiber cleaning assembly positionable adjacent a lickerin roll of a carding machine. The fiber cleaning system has a number of spaced segments conforming generally to the configuration of the lickerin roll with fastening means for removably securing the spaced segments for varying the angular, as well as the proximity settings between the segments and the lickerin roll. The settings may also be varied between segments. A number of depending baffles are removably mounted beneath the spaced screen segments for controlling air flow and increasing waste extraction through the lickerin.

1 Claim, 2 Drawing Figures

Fig. 1.
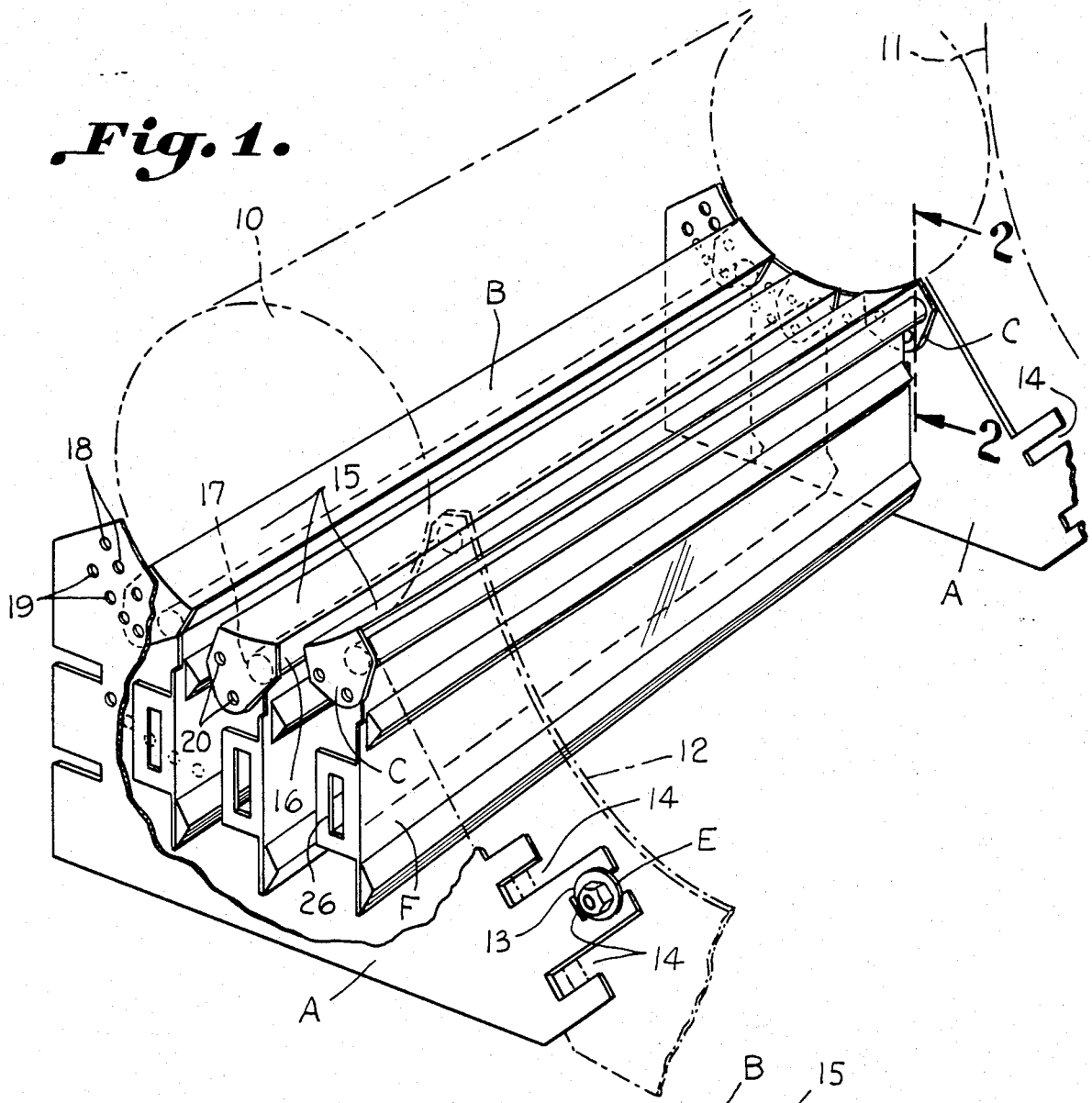
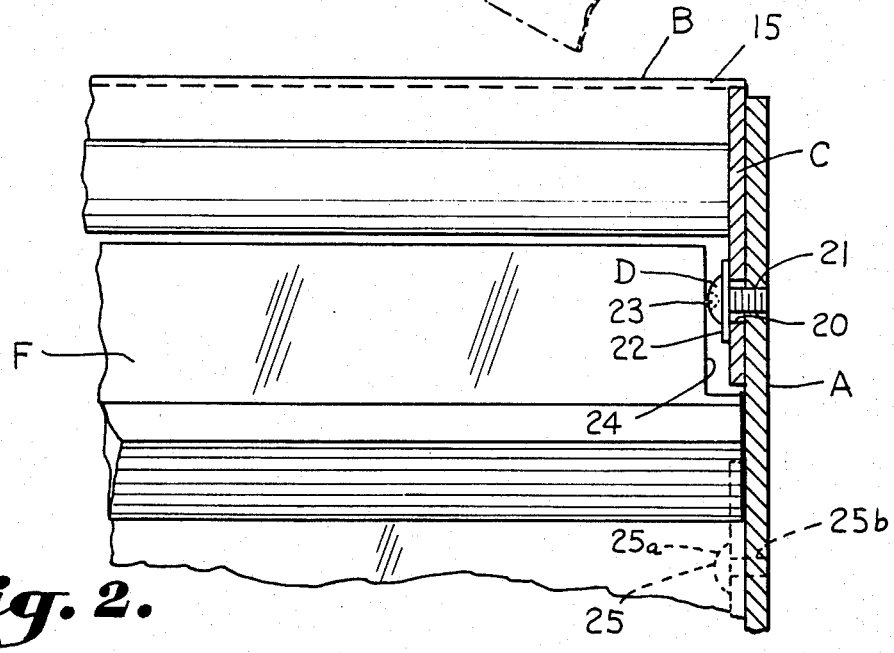
Fig. 2.

CARD SCREEN ASSEMBLY

BACKGROUND OF THE INVENTION

Heretofore, lickerin screens and the like have been provided which are essentially provided with spaced screen bars which are not attachable with respect to angularity or with respect to each other. Instead, the whole unit, including side frame members are generally adjustable to vary the settings with respect to the clothed roll of the carding apparatus. Apparatus which is similar to mote knives are illustrated in connection with a beater rather than a carding machine, U.S. Pat. No. 244,393. Mote knives are illustrated in connection with a lickerin wherein the mote knives are carried by plates adjustable with respect to the lickerin as illustrated in U.S. Pat. No. 2,188,458. The prior art further includes in connection with a grid section for a beater, grid bars having adjustments for angularity and with respect to the beater, but not with respect to each other. It is desirable to provide a fiber cleaning system which is provided with independent segments which may be removable in their entirities and which have adjustment with regard to angularity, as well as with respect to each other and to the roll of a carding machine. It is also desirable that such apparatus be capable of being mounted on the back screen of the card and be provided with removable baffles beneath the segments of the screen so that air control may be possible to act in a fashion similar to that of a fiber retriever such as illustrated in U.S. Pat. No. 3,955,244. Thus, air currents may be controlled so that there is a separation of air to cause light fibers to flow back up to the lickerin while the trash passes between the segments and is not allowed to re-enter the process and is collected in a manner provided for removal. Undersirable fibers and trash are propelled by centrifugal force and separated from the surface of the lickerin by the slope of the segments.

Thus, it is important to provide a screen capable of use in connection with a carding element wherein the fibers are in open condition on the teeth as opposed to a beater wherein chokes or chunks of fibers are utilized which are not on the teeth such as illustrated in U.S. Pat. No. 2,681,478.

It is desirable in connection with finer grades of stock to utilize the baffles, whereas in connection with heavier stock, it is possible to leave out the baffles and perhaps one or more of the screen segments to increase exposed area for centrifugal force to act.

An important advantage of carding apparatus employing an assembly constructed in accordance with the invention may be noted from the fact that large quantities of waste, for example, on the order of 8–15% may be removed for reclaimation by means of a suitable reclaimation system such as another carding machine. Other waste removal systems presently employed on carding machines are capable of removing only about 2–3% of the fibers as waste. With apparatus constructed in accordance with the present invention, the space between the bars may be adjusted to take out whatever amount of fibers as waste is desirable.

A major purpose of the fiber cleaning system is to remove the highest percentage possible of very short or immature fibers which are very detrimental to good yarn quality and are particularly detrimental to dyeing, as well as while controlling the amount of short fiber which is not conducive to spinning into good wuality yarn and which should be removed for first quality work. It is also important to minimize the amount of spinnable fiber which is that fiber whose staple length allows it to be drafted evenly and spun into good quality yarn.

This is accomplished by distributing as little as possible the good fibers which are securely held by the teeth of the lickerin cloting, while at the same time using the independently adjustable segments or baffles to direct the air current existing around the lickerin and the centrifugal forces created by the rotational speed of the lickerin to remove the maximum amount of undesirable material. It is through that the useful fibers are held by the teeth of the lickerin securely and that the shorter the fiber the less securely it is held. The trash is apparently not held by the teeth but is pushed to the outer surface of the flow of material and resists the forward motion of the flow of material to some extent.

SUMMARY OF THE INVENTION

It has been found that an improved card screen may be provided, particularly for use on lickerins, which is mountable upon the back screen so that adjustment will automatically occur by self-adjustment when the lickerin is adjusted. The segments are capable of multi-positioning and the number utilized varied. Each screen segment is adjustable and angular adjustment varied independently between each other, and in relation to the lickerin. The screen segments are shaped to conform generally to the carding element to provide maximum air control and are mounted upon plates which are capable of angular adjustment with respect to side frame members through the use of spaced angularly disposed oversized holes. The screen is provided with mounting means for attachement to the back screen of the card and means are provided for removably and adjustably positioning baffles beneath the screen segments.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein:

FIG. 1 is a perspective view illustrating a card screen constructed in accordance with the present invention with attachment means for securement to the back screen of a card and being fastenable on the opposite end to a suitable mounting for the side frame members, and FIG. 2 is a sectional front elevation taken on the line 2—2 in FIG. 1 illustrating the means of securing the segments and baffles between the side frame members of the card screen.

DESCRIPTION OF A PREFERRED EMBODIMENT

The drawing illustrates a card screen positionable adjacent a fiber intake portion of a lickerin roll having opposed side frame members A spaced adjacent ends of the lickerin roll. Spaced screen segments B conforming generally to the configuration of the lickerin roll are removably positioned in carding relation thereto between the side frame members. End frame members C are carried by each of the segments aligned with the respective side frame members. Spaced aperture means in the end frame members correspond to aperture means in the side frame members, and fastening means D extend between the respective aperture means permitting angular as well as proximity settings between the segments and the lickerin roll as well as circumferential spacing between segments. Mounting means E position the card screen upon a back screen. Baffles F depend beneath the segments, and adjustable means are provided for positioning the baffles upon the side frame members.

FIG. 1 shows a carding element in broken lines in the form of a lickerin illustrated at 10. A cylinder is illustrated in broken lines at 11. One of the side frame members of the back screen is illustrated in broken lines as at 12. The side plate of all side frame members A have connection to the back screen as by suitable fastening means, such as the bolts 13 within one of the respective openings 14 of the side frame members. The side frame members A are thus suitably secured between the respective sides of the carding machine.

The spaced screen segments B which conform generally to the configuration of the lickerin roll 10, are illustrated as including a substantially flat segment portion 15 which may be curved slightly to better facilitate its conformity to the lickerin. The frame portion 15 extends downwardly on one end as at 16 and has a rolled portion 17 carried adjacent the free end thereof to provide stiffness. The segments B are carried between end frame members C which are aligned with respective side frame members A. Spaced aperture means are provided in the form of a circumferentially spaced row of openings illustrated at 18, and a second row of circumferentially spaced openings 19 positioned therebeneath. Oversized spaced openings 20 are provided in each of the end frame members C for providing angular adjustment and fine adjustments with respect to the lickerin and with respect to adjacent segments. Proximity adjustments may be provided by selecting the aperatures to which the segments are secured.

Fastening means D are best illustrated in FIG. 2 as extending between the respective aperture means to permit the aforesaid adjustments and settings. The fastening means include a threaded shank 21 which has threadable fastening within the side frame members A passing through the oversized aperture 20 in the end frame members C. A washer 22 is provided to facilitate securement beneath the enlarged portion 23 carried by the shank.

The mounting means E for positioning the card screen upon the back screen includes the threaded fastening member 13 which may be similar to the fastener just described in connection with the fastening means D, for mounting the card screen upon the back screen of a existing carding machine. The baffles F have cutout portions 24 adjacent each end to accommodate the end plates C and fastening means D, but yet provide a substantially airtight seal beneath each of the spaced screen segments. Fastening means include a threaded fastening member 25 which passes through slots 26 (FIG. 1) for securement of the baffles in vertically adjusted position beneath the spaced screen segments. The threaded members 25 have securement with an enlarged head portion **25*a* at one end, and a threaded shank 25*b*** at the other which has securement in the respective opposed side frame member A.

The fiber cleaning system works by allowing the necessary amount of free space for the trash and short fiber to break free of the flow of material and be separated from the flow by the design, and settings, of the cleaning segment while the segments are also helping the good fiber to be held more securely by the teeth of the lickerin.

The amount of free space necessary to accomplish this will vary with the grade of stock being run as well as the design and speed of the lickerin. Therefore, the complete independence of each segment as to its position, angularity, and proximity to the lickerin and its relationship to the other segments required by the existing conditions allows for the thorough cleaning to be accomplished. The air control baffles which are provided for use under the segments if required are to create an upward draft of air current similar in fashion to that of a Fiber Retriever.

While a preferred embodiment of the invention has been described using specific terms, such description is for illustrative purposes only, and it is to be understood that changes and variations may be made without departing from the spirit or scope of the following claims.

What is claimed is:

1. A card screen assembly positionable adjacent a fiber intake portion of a lickerin roll of a carding machine comprising:

opposed side frame members spaced adjacent ends of said lickerin roll;

spaced screen segments conforming generally to the configuration of the lickerin roll removably positionable in carding relation thereto between said side frame members;

end frame members carried by each of said segments aligned with said respective side frame members;

spaced aperture means in each of said end frame members and corresponding spaced pairs of aperture means in said side frame members;

one of said respective aperture means in said end frame members and said side frame members being oversized in respect to said fastening means; and removable threaded fastening means extending between said respective aperture means permitting angular as well as proximity settings between said segments and said lickerin roll and circumferential space settings between segments.

* * * * *